US005379226A

United States Patent [19]

Shigeta

[11] Patent Number: 5,379,226

[45] Date of Patent: Jan. 3, 1995

[54] SEWING DATA FORMING DEVICE FOR SEWING MACHINING

[75] Inventor: Katsunori Shigeta, Aichi, Japan

[73] Assignee: Mitsubishi Denki Kabushiki Kaisha, Tokyo, Japan

[21] Appl. No.: 857,955

[22] Filed: Mar. 26, 1992

[30] Foreign Application Priority Data

Mar. 29, 1991 [JP] Japan ..... 3-066539

[51] Int. Cl.[6] ..... G06F 15/46; D05B 21/00

[52] U.S. Cl. ..... 364/470; 112/103; 112/121.12

[58] Field of Search ..... 364/470; 112/103, 121.11, 112/121.12, 262.1, 266.2, 80.23, 445

[56] References Cited

U.S. PATENT DOCUMENTS

| | | | |
|---|---|---|---|
| 4,135,454 | 1/1979 | Manabe et al. | 112/121.12 |
| 4,352,334 | 10/1982 | Childs et al. | 112/266.1 |
| 4,385,570 | 5/1983 | Yanagi | 112/121.12 |
| 4,429,364 | 1/1984 | Maruyama et al. | 112/121.11 |
| 4,444,135 | 4/1984 | Yanagi et al. . | |
| 4,499,838 | 2/1985 | Voza . | |
| 4,520,745 | 6/1985 | Shinomiya et al. | 112/103 |
| 4,622,907 | 11/1986 | Kimura | 112/121.12 |
| 4,742,786 | 5/1988 | Hashimoto et al. | 112/121.12 |
| 4,849,902 | 7/1989 | Yokoe et al. . | |
| 5,009,176 | 4/1991 | Shigeta et al. . | |
| 5,239,475 | 8/1993 | Shigeta et al. | 364/470 |

*Primary Examiner*—Roy N. Envall, Jr.
*Assistant Examiner*—Thomas E. Brown
*Attorney, Agent, or Firm*—Sughrue, Mion, Zinn, Macpeak & Seas

[57] ABSTRACT

A sewing data forming device which forms sewing data to form a fine seam merely by inputting the coordinate data of a plurality of points on a free curve which includes the start and end points. The sewing data forming device for a sewing machine comprises data input unit for inputting coordinate data of a plurality of points along a sewing pattern, the data input unit designating an input condition among point input, linear input and curve input, data storage unit for storing data inputted by the data input unit successively, and data processing unit for applying inclination data to each of the coordinate data so as to form the sewing data between the points adjacent to each other according to a stitch length specified for an interval therebetween.

5 Claims, 10 Drawing Sheets

SEWING DATA FORMING DEVICE FOR SEWING MACHINING

BACKGROUND OF THE INVENTION

This invention relates to a sewing data forming device for a sewing machine equipped with a cloth presser device which is to drive a material to be sewed (hereinafter referred to as "a sewing material", when applicable) according to predetermined sewing data.

An industrial sewing machine has been put in practical use which is so designed that, according to sewing data programmed and stored in a memory unit, a sewing material (work) such as a cloth is moved in a predetermined plane while being held, to automatically form a desired sewing pattern on it. The sewing data are stored in a memory medium in the memory unit, to form a variety of sewing patterns on the sewing materials. The memory medium is, for instance, a semiconductor memory, magnetic card, or floppy disk. Data for controlling the operation of the sewing machine are stored in the memory medium in the order of sewing operations.

The control data includes control instructions for controlling an amount of relative displacement of a needle and a cloth, and a sewing speed for every stitch by the sewing machine forming a sewing pattern, and those for controlling the operations of the sewing machine and an electric motor adapted to drive the sewing machine. Control data for one sewing pattern is the assembly of control instructions for a number of stitches. Hence, in order to form a desired sewing pattern on a sewing material with the sewing machine, it is necessary to form sewing data for the sewing pattern in advance and to store them in the memory medium.

FIG. 1 is a perspective view showing a conventional sewing data forming device for a sewing machine which is disclosed by Published Unexamined Japanese Paten Application No. 148582/1985. The device comprises a tablet digitizer 10 including inputting means having a menu section 11, a pattern input section 13, a cursor means 12 such as a mouse to select a desired item from the menu section 11 and to obtain coordinate data from the pattern input section 13. Further in FIG. 1, reference numeral 20 designates an LED (light emitting diode) display panel in the sewing data forming device which comprises a variety of switches and LEDs; 26, a CRT (cathode ray tube) for displaying pattern data; 18, a PROM (programmable read-only memory) section for writing sewing data in a memory medium such as a PROM and for reading the sewing data from the PROM; and 8, an eraser for erasing the sewing data from the PROM.

FIG. 2 shows the menu section 11 in more detail, and the cursor means 12 comprising a reading section 12*a* and a switch 12*b*.

The operation of the conventional sewing data forming device will be described with reference to FIG. 3 which is an explanatory diagram showing the arrangement of the device.

A desired sewing pattern is drawn on the tablet digitizer with the mouse 12. In compliance with the sewing pattern thus drawn, sewing data is formed mainly under the control of a CPU 14 and then stored in a RAM 24 temporarily. Then, a PROM writer 16 is operated to write the sewing data thus stored in the RAM 24 to the PROM 18 contained in a PROM cassette 42 through a gate 44. The PROM cassette 42 is loaded in the a sewing machine control device 40 to drive the sewing machine 38. The settings of modes and the procedure of operations in the formation of sewing data are applied, as I/O data, through the gate 44 to the LED display panel 20 to be displayed thereon. The program for writing the input data from the tablet digitizer 10 through the gate 44 in the PROM 18, according to which the CPU 14 operates, has been stored in a system program ROM 22. X and Y coordinate data, which are input data from the table digitizer 10, are stored temporarily in the RAM 24. By operating the input data, sewing data, namely, X and Y coordinate data are obtained. The amounts of variation of the X and Y coordinate data; that is, relative value data thereof are also stored in the RAM 24. The pattern display CRT 26 is provided to monitor the pattern data inputted from the tablet digitizer 10. With the aid of the CPU 14, the sewing data stored in the RAM 24 are converted into image displaying data, which are applied through a gate 33 to an image data RAM 28 so as to be stored therein. Thus, the sewing pattern is displayed on the CRT 26 by a CRT control circuit 46, which facilitates the data inputting operation of the operator.

FIG. 4(*a*) shows one example of a sewing pattern. Now, a concrete data inputting method will be described. First, a drawing on which the sewing pattern as shown in FIG. 4(*a*) has been drawn is stuck on the pattern inputting section 13 of the tablet digitizer 10. Thereafter, with the reading section 12*a* of the mouse 12 set at the "Pattern Input" of the menu section 11, the switch 12*b* is operated so as to input the sewing pattern. Similarly, in the menu section 11, "Scale", "1", "0", "0", "Stitch length", "3", ".", "0", "Low speed", "Point input" and "Start" are selected successively, to set input conditions. In this case, the scale is set to 100%; that is, the data in the drawing are equal in scale to data inputted, and when two points are inputted, sewing data of 3.0 mm is produced. Further, the sewing speed is made low and an input condition is set to point input.

Thereafter, with the reading section 12*a* of the mouse 12 set at the origin 0 of the sewing pattern 10*a*, the switch 12*b* is operated to input the origin's position. Under this condition, the items in the menu section 11 and the points of the sewing pattern are inputted with the mouse 12 in the following order: "Idle feed", point A→point B→"Straight line input", "High speed", point C→"Point input", "Middle speed 1", point D→point E→"Straight line input", "High speed", point F→"Pause", point G→"Point input", "Middle speed 1", point H→point I→Straight line input", "High speed", point J→"Idle feed", origin 0→"End".

FIG. 4(*b*) shows another example of the circular sewing pattern. The sewing pattern can be inputted by the same method as the sewing pattern of FIG. 4(*a*). However, the inputting of the sewing pattern shown in FIG. 4(*b*) is troublesome when compared with the inputting of the one shown in FIG. 4(*a*), because the sewing pattern is a free curve, and therefore after point A is inputted, point $A_1$, the remaining points—point $A_2$, point $A_3$ . . . point $A_{41}$, point $A_{42}$, point $A_{43}$, point $A_{44}$ and point J forming the circular sewing pattern—must be all inputted correctly.

Thus, the inputting of the sewing pattern shown in FIGS. 4(*a*) and 4(*b*) has been accomplished. During the inputting operation, the scale value, stitch length, speed instruction values, and inputting method are displayed on the LED display panel 20 whereas the sewing pattern is displayed on the CRT 26.

FIG. 5 is a flow chart showing a data processing operation corresponding to the above-described data inputting operation. When the switch 12*b* of the mouse 12 is operated in Step S1, the coordinate data are read in Step S2. In Step S3, it is determined whether the data thus read in Step S2 is the one selected from the menu section 11 or whether it is of the sewing pattern. When it is determined that the data is selected from the menu section 1, Step S5 is effected. In Step S5, it is determined which of the items in the menu section 11 has been selected. And, in Step, S6, a process corresponding to the item selected from the menu is carried out. When, on the other hand, the data read in Step S2 is of the sewing pattern in Step S3, the coordinate data read in Step S4 are subjected to arithmetic operation. In Step S7, sewing data is formed, and an operation for displaying the sewing data together with the result of process in Step S6 on the LED display panel is carried out. Thereafter, in Step S8, an operation for displaying the sewing data thus formed on the CRT 26 or writing in the PROM 18 is carried out.

Being designed as described above, the conventional sewing data forming device is difficult to convert a sewing pattern made up of free curves into sewing data high in quality (promising fine seams) with specified stitch length.

SUMMARY OF THE INVENTION

Accordingly, an object of this invention is to eliminate the above-described difficulty accompanying a conventional sewing data forming device. More specifically, an object of the invention is to provide a sewing data forming device with which sewing data providing fine seams can be formed merely by inputting the coordinate data of a plurality of points on a free curve which includes the start and end points thereof.

The above, and other objects of the present invention are accomplished by the provision of a sewing data forming device for a sewing machine comprising: data input means for inputting coordinate data of a plurality of points along a sewing pattern, the data input means designating an input condition among point input, linear input and curve input; data storage means for storing data inputted by the data input means successively; and data processing means for applying inclination data to each of said coordinate data so as to form the sewing data between the points adjacent to each other according to a stitch length specified for an interval therebetween.

In the sewing data forming device, the sewing data for the interval between the points adjacent to each other are formed on a curve approximated by a cubic expression.

In the sewing data forming device, the input coordinate data of (N−1)th point, N-th point and (N+1)th point are subjected to arithmetic operation, to apply inclination data representing an inclination to the input coordinate data of the N-th point, the N being a positive integer.

In the sewing data forming device, the inclination data of the N-th point is obtained by an average of the inclination of a straight line bridging the (N−1)th and N-th points and the inclination of a straight line bridging the N-th and (N+1)th points.

In the sewing data forming device, an inclination of a straight line bridging the first and second points is applied as the inclination data of the first point whereas an inclination of a straight line bridging the last point and the last but one point is applied as the inclination data of the last point.

In the sewing data folding device, the same inclination data is applied to the first and last points in the case where the coordinate data of the last point is coincident with or close to the coordinate data of the first point.

In the sewing data forming device, the same inclination data is obtained by the average of the inclination of a straight line bridging the first and second points and the inclination of a straight line bridging the last and the last but one points.

DESCRIPTION OF THE PREFERRED EMBODIMENT

Figure 6:
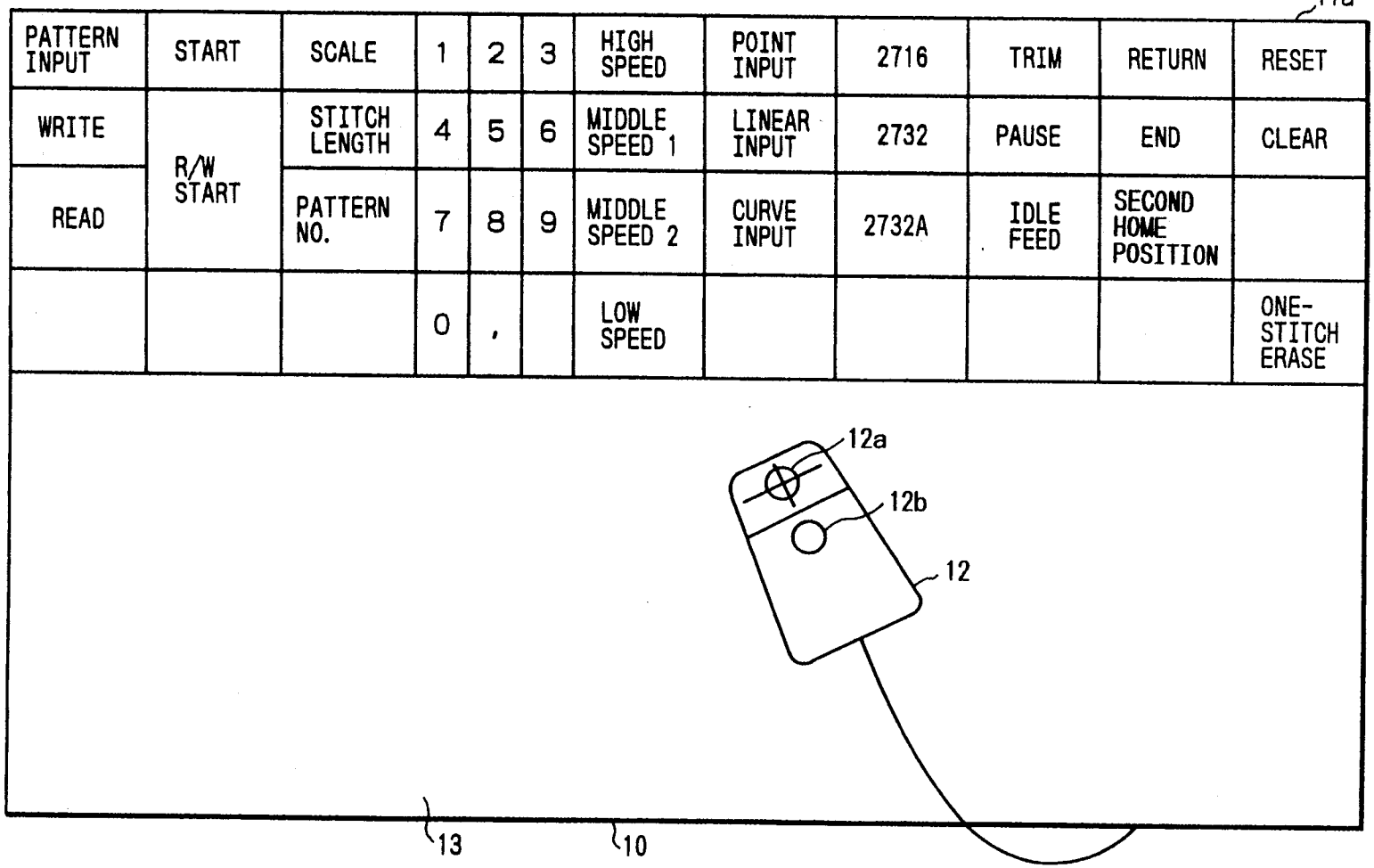
FIG. 6 is an explanatory diagram showing a tablet digitizer and a mouse in an example of a sewing data forming device in a sewing machine which constitutes one embodiment of this invention.

An embodiment of this invention will be described. FIG. 6 shows a tablet digitizer 10 and a menu section 11*a* according to the invention. As shown in FIG. 6, the menu section 11*a* includes a menu key "Curve Input " which, when sewing data are formed for a free curve, is selected with the reading section 12*a* of a mouse 12. More specifically, the menu key "Curve Input " is selected at the start of a sewing data forming operation or during the sewing data forming operation, and data on a plurality of coordinates including those of the start and end points of a given free curve are inputted to form the sewing data along the free curve.

Now, the data inputting method will be described concretely according to the sewing pattern shown in FIG. 4(*b*). The data inputting method is substantially equal to that which has been described with reference to the conventional sewing data forming device.

Figure 4A:
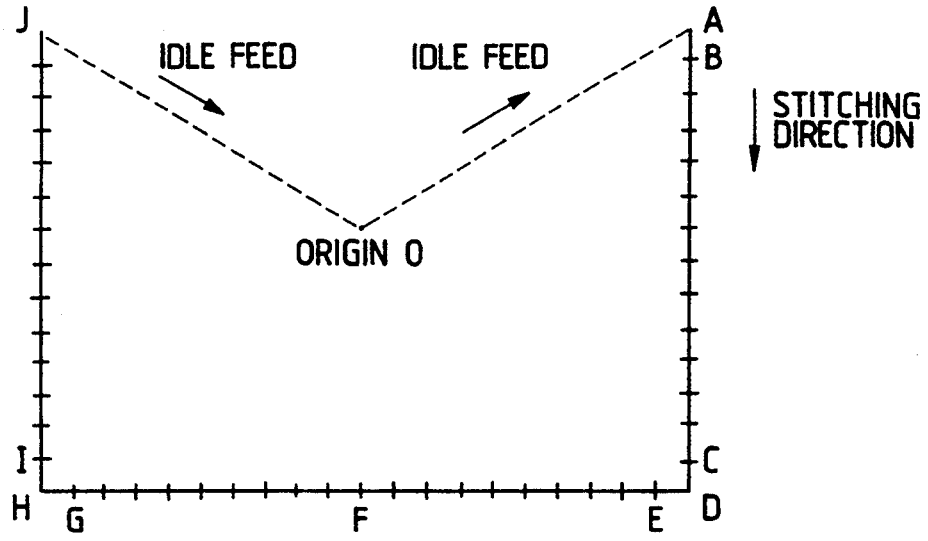
FIGS. 4(*a*) and 4(*b*) are explanatory diagrams showing examples of a sewing pattern.
Figure 4B:
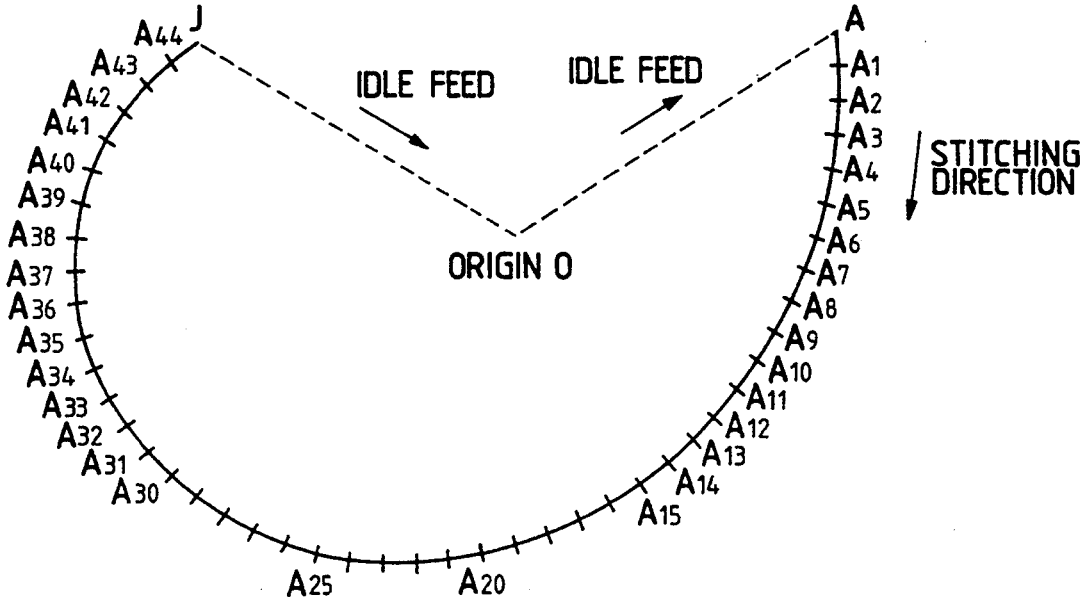
Figure 5:
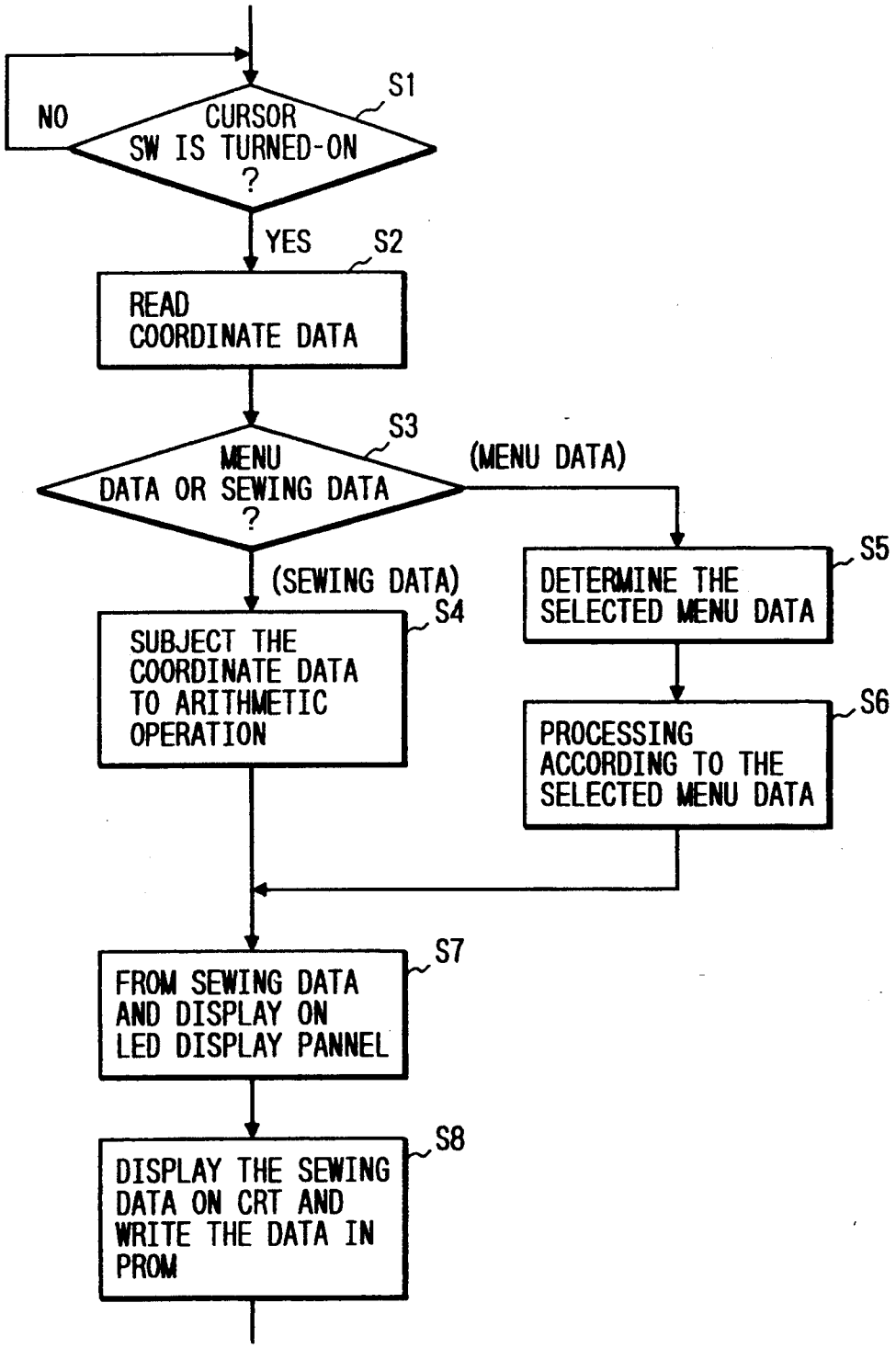
FIG. 5 is a flow chart for a description of the operation of the conventional sewing data forming device.

First, a drawing on which the sewing pattern as shown in FIG. 4(*b*) has been drawn is stuck on the pattern inputting section 13 of the tablet digitizer 10. Thereafter, with the reading section 12*a* of the mouse 12 set at the "Pattern Input " of the menu section 11*a*, the switch 12*b* is operated so as to input the sewing pattern. Similarly, in the menu section 11, "Scale", "1", "0", "0", "Stitch Length", "3", ".", "0", "Low speed", "Curve Input" and "Start" are selected successively, to set input conditions. In this case, the scale is set to 100%; that is, the data shown in the drawing are equal in scale to the data inputted, and the speed instruction inputted is of low speed, and the inputting method is for curves.

Thereafter, with the reading section 12*a* of the mouse 12 set on the origin 0 of the sewing pattern shown in FIG. 4(*b*), the switch 12*b* is operated to input the origin's position. Under this condition, the relevant items of the menu section 11*a* and the positions of the relevant points on the sewing patterns are inputted with the mouse 12 in the following order: "Idle Feed", point A→"Curve Input", "High Speed", point $A_5$→point $A_{10}$→point $A_{15}$→point $A_{20}$→point $A_{25}$→point $A_{30}$→point $A_{35}$→point $A_{40}$→point J→"Curve Input"→"Idle Feed", origin point 0→"End". For convenience in description, the points $A_5$, $A_{10}$, . . . $A_{40}$ and J are selected as the input points; however, in practice, any points on the curve can be employed.

The inputs of the points from the point immediately before the menu key "Curve Input" is operated; i.e., the point A to the point immediately after the menu key "Curve Input" is operated next; i.e., the point. J are subjected to arithmetic operation by arithmetic means (described later), to obtain points A, $A_1$, $A_2$, $A_3$, $A_4$ . . . $A_{44}$ and J which form the aimed sewing pattern.

Thus, the operation of inputting the sewing pattern shown in FIG. 4(*b*) has been accomplished. In this operation, the scale value, stitch length, speed instruction value, and input method are displayed on the LED display panel 20. In the above-described pattern inputting operation, by operating the switch 12*b* of the mouse 12, sewing data are successively formed and stored in the RAM 24, and in order to display positions, the absolute values of the sewing data with the position of the input origin point as a reference are stored in the RAM 28.

Figure 7A:
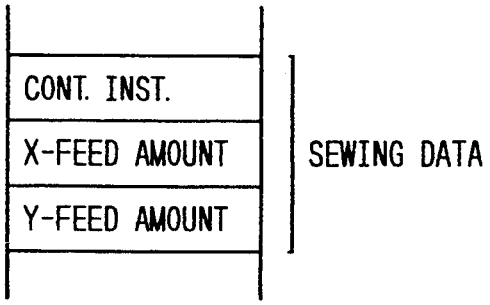
FIGS. 7(*a*) and 7(*b*) is an explanatory diagrams showing the arrangement of sewing data.
Figure 7B:
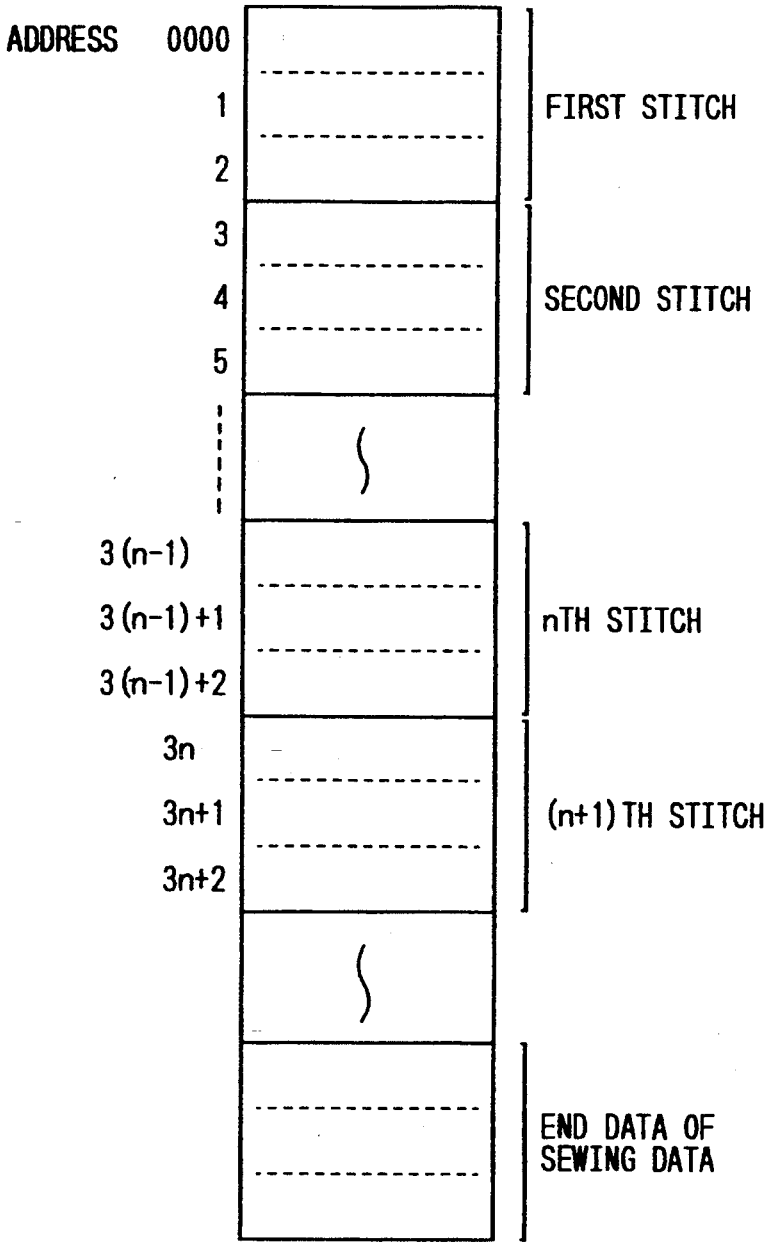

FIGS. 7(*a*) and 7(*b*) show the arrangement of the sewing data stored in the RAM 24. FIG. 7(*a*) shows one unit of sewing data of a stitch. That is, the first byte stores the above-described control instruction, the second byte stores stitch data or the amount of X-axis feed of the idle feed data, and the third byte stores stitch data or the amount of Y-axis feed of the idle feed data. The one unit of sewing data, as shown in FIG. 7(*b*), are stored in predetermined addresses in the inputting order beginning from the first stitch to the end data which is one of the control instructions of sewing data.

Figure 8:
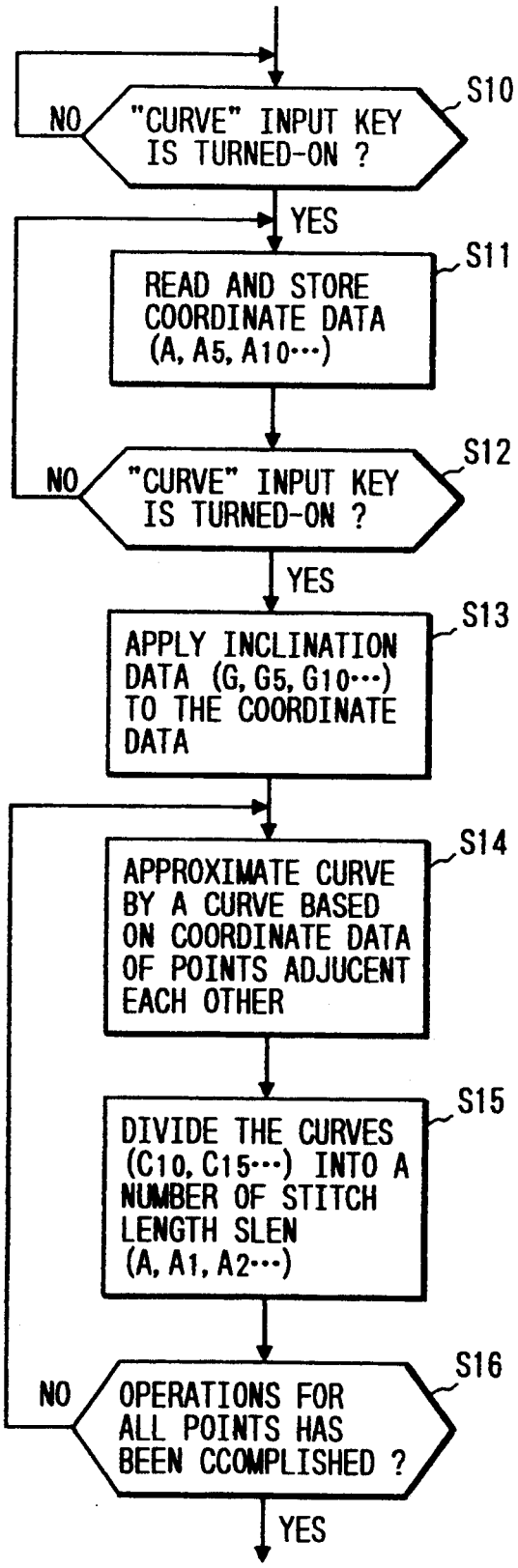
FIG. 8 is a flow chart for a description of the operation of the sewing data forming device according to the invention.

FIG. 8 is a flow chart for a description of the operation of the sewing data forming device according to the invention.

Figure 1:
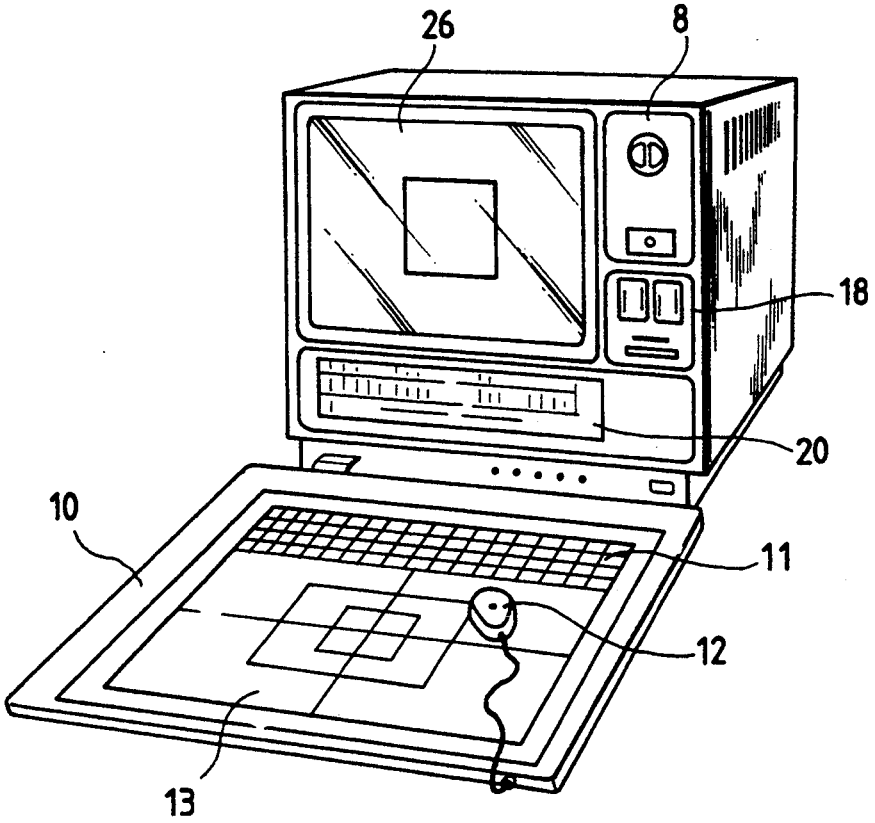
FIG. 1 PRIOR ART
FIG. 1 is a perspective view showing a conventional sewing data forming device in a sewing machine.
Figure 2:
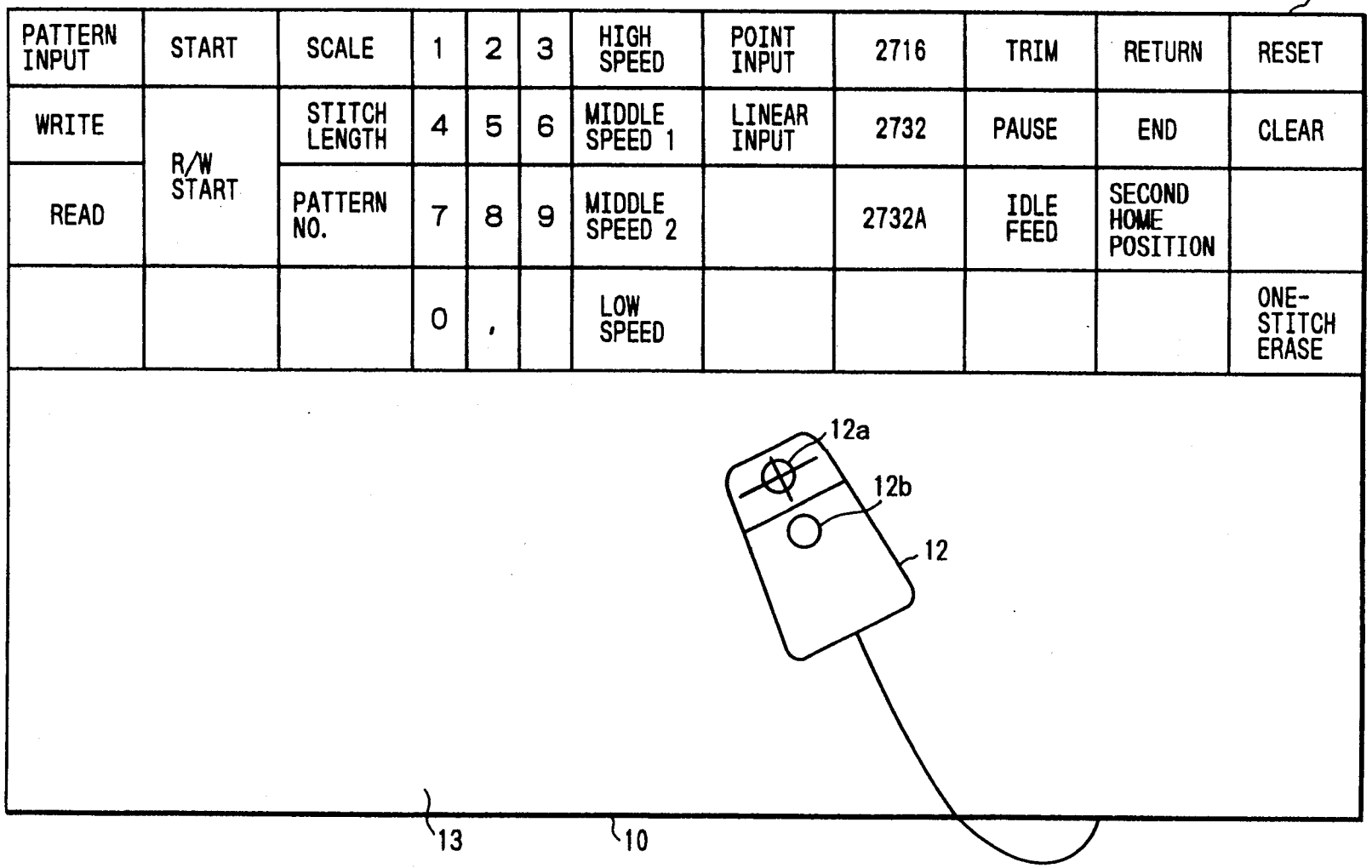
FIG. 2 is an explanatory diagram showing a tablet digitizer and a mouse in the conventional sewing data forming device.
Figure 3:
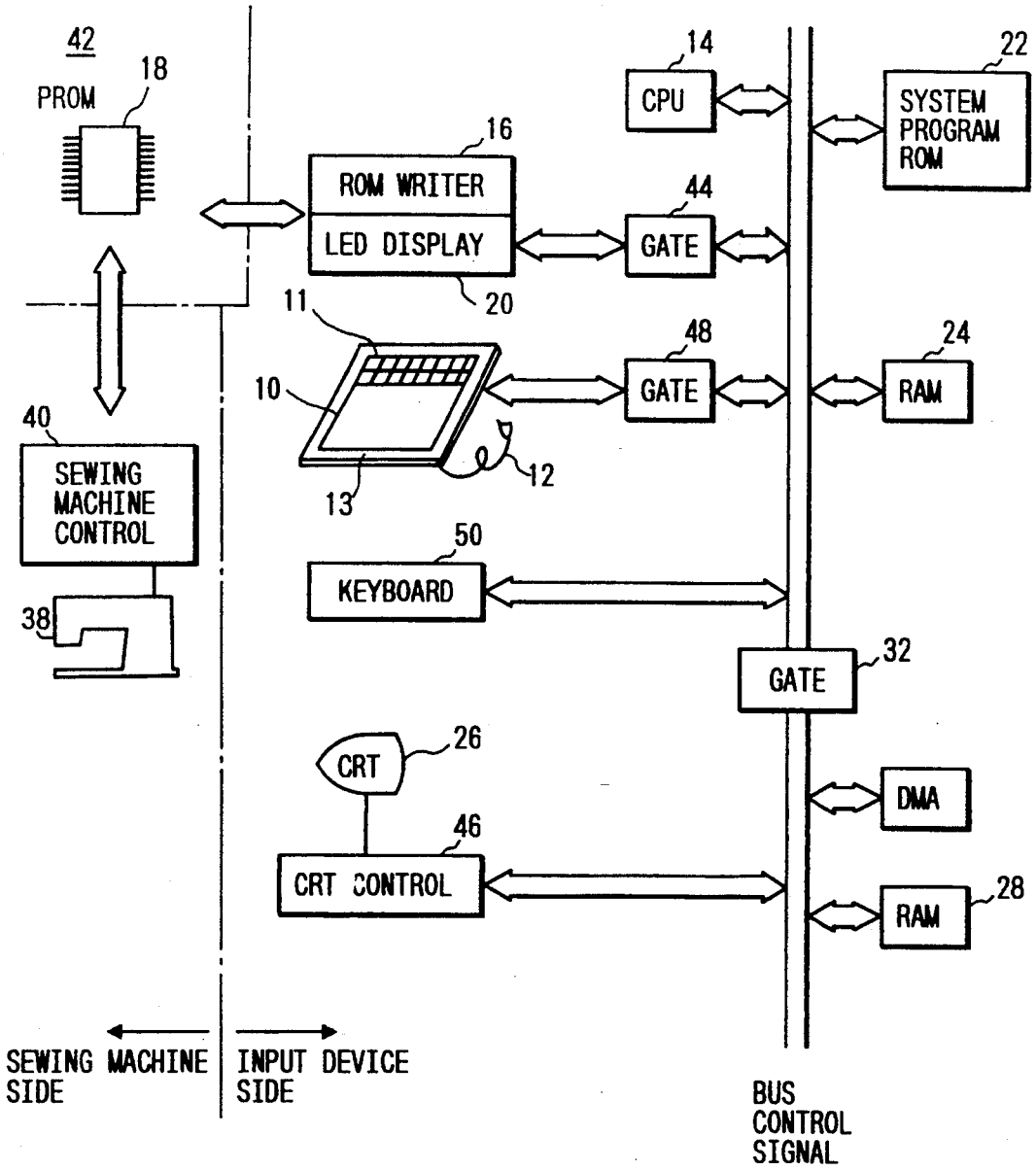
FIG. 3 is an explanatory diagram, partly as a block diagram, showing the arrangement of the conventional sewing data forming device.

When the menu key "Curve Input" is selected with the switch 12*b* of the mouse 12, a sewing data forming mode by curve inputting is established in Step S10 of FIG. 8. In Step S11, coordinate data (points A, $A_5$, $A_{10}$, $A_{15}$ . . . $A_{40}$ and J) inputted are read and stored in the RAM 24 shown in FIG. 3 successively.

When the menu key "Curve Input" is operated again in Step S12, Step S13 is effected. In Step S13, inclination data (G, $G_5$, $G_{10}$, $G_{15}$, . . . $G_{40}$ and GJ) are applied to the coordinate data (of the points A, $A_5$, $A_{10}$, $A_{15}$, . . . $A_{40}$ and J) respectively.

The inclination data G determines the inclination of the straight line connecting the points A and $A_5$. That is, assuming that the coordinates of the point A is represented by ($X_a$, $Y_a$) and the coordinates of the point $A_5$ by ($X_{a5}$, $Y_{a5}$), the data G can be calculated from the following equation:

$$G=(Y_{a5}-Ya)/(X_{a5}-X_a)$$

At any one of the points $G_5$ through $G_{40}$, the inclination is determined as the average of the inclination of the straight line connecting the point and the preceding point and the straight line connecting the point and the following point. That is, the average is calculated from the following equation. In this case, the inclination of a point $A_n$ is $G_n$, and the coordinates of the preceding point $A_{n-1}$, the point $A_n$ and the following point $A_{n+1}$ are ($X_{an-1}$, $Y_{an-1}$), ($X_{an}$, $Y_{an}$) and ($X_{an+1}$, $Y_{an+1}$), respectively.

$$Gn=\tfrac{1}{2}[\{(Y_{an}-Y_{an-1})/(X_{an}-X_{an-1})\}+\{(Y_{an+1}-Y_{an})/(X_{an-1}-X_{an})\}]$$

The last inclination data GJ determines the inclination of the straight line connecting the points $A_{40}$ and J. That is, it can be calculated from the following equation. In this case, the coordinates of the point $A_{40}$ is ($X_{a40}$, $Y_{a40}$), and the coordinates of the point J is ($X_j$, $Y_j$).

$$GJ=(Y_j-Y_{a40})/(X_j-X_{a40})$$

The inclination data (G, $G_5$, $G_{10}$, $G_{15}$, . . . $G_{40}$ and GJ) for all the inputted points are calculated, so that they are stored in the RAM 24 shown in FIG. 3.

Figure 11:
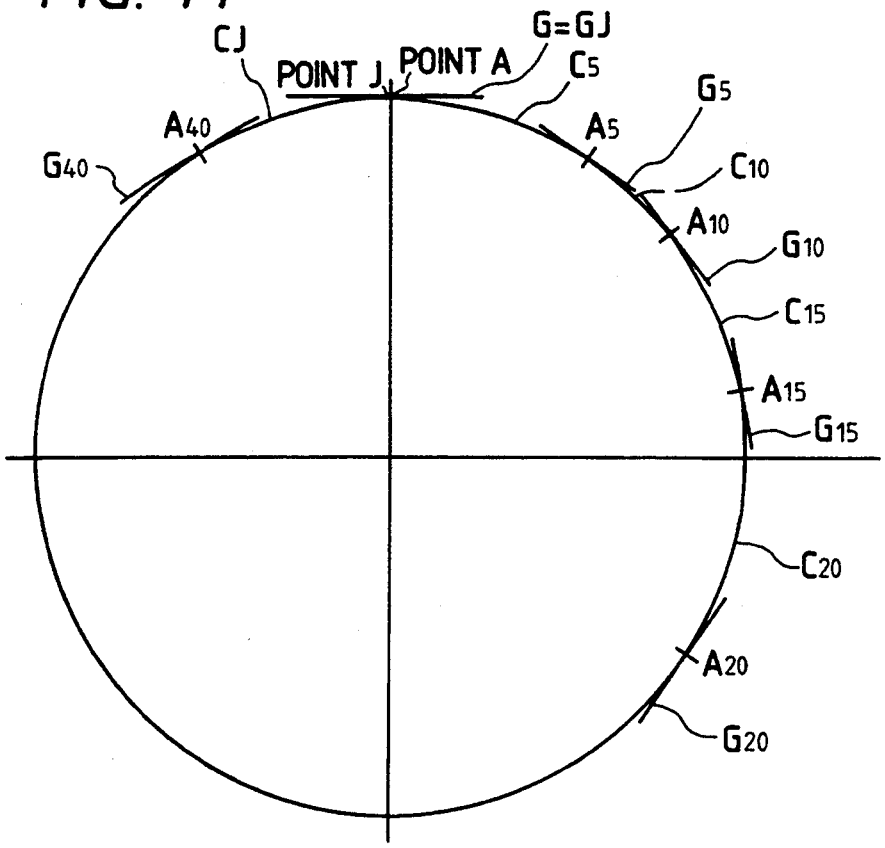

In the case where the start point (the point A) and the end point (or the point J) of the pattern are one and the same point as in the case of a circle shown in FIG. 11, or close to each other, the inclinations of all the points are calculated, and the inclinations (G and GJ) of the start and end points are calculated again from the following equation. That is, as for the start and end points, the inclinations thus calculated are employed. This method is advantageous in that the start and end points are connected smoothly.

$$G=GJ=(G+GJ)/2$$

Next, in Step S14, a curve approximated by a cubic expression is calculated to connect the points (cf. FIG. 9), the cubic expression being as follows:

$$Y=LX^3+MX^2+NX+P.$$

A curve $C_5$ approximated by the cubic expression to connect the points A and $A_5$ can be obtained by arithmetic operation on the coordinates of the points A and $A_5$ and the inclinations $G_A$ and $G_5$of the points A and $A_5$ which have been obtained before. In this case, assuming that the coordinates of the point A and $A_5$ are (0, 0) and ($X_{a5}$, $Y_{a5}$), respectively, and the inclinations thereof are $G_A$ and $G_5$, constants in the cubic expression can be determined as follows:

$P=0$;

$N=G_A$;

$M=3(Y_{a5})/(X_{a5})^2-(G_5+2G_A)/(X_{a5})$; and $L=\{G_5-G_A-2M(X_{a5})\}/3(X_{a5})^2$.

Figure 9:
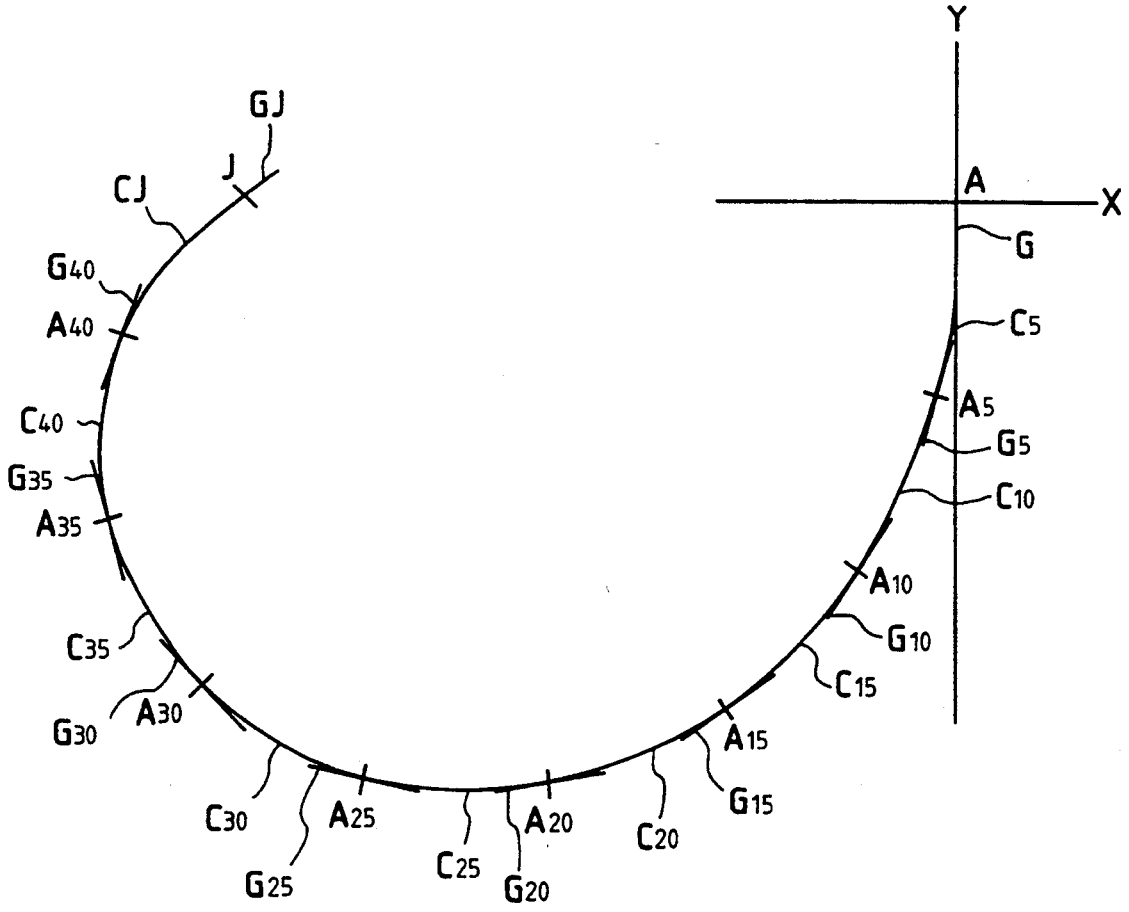
FIGS. 9, 10 and 11 are explanatory diagrams for complement of the description of a calculating method which is made with reference to the flow chart shown in FIG. 8.

In the same manner, curves $C_{10}$, $C_{15}$, $C_{20}$, . . . $C_{40}$ and CJ can be obtained to connect the points $A_5$ and $A_{10}$, the point $A_{10}$ and $A_{15}$, the points $A_{15}$ and $A_{20}$, . . . the points $A_{40}$ and J, respectively. FIG. 9 is a diagram for a description of the above-described operations . The curve in FIG. 9 is substantially similar to the one shown in FIG. 4(*b*).

Figure 10:
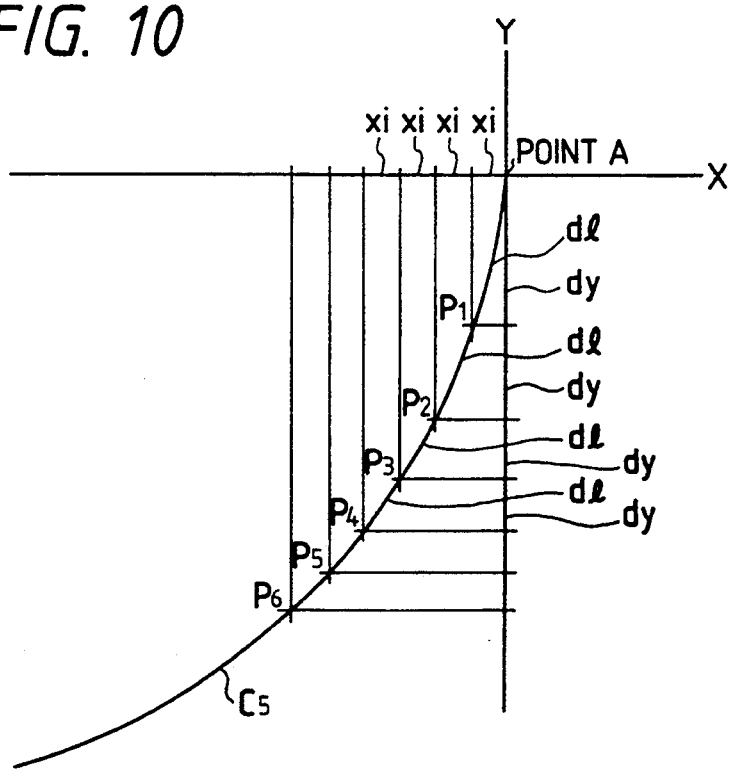

Thereafter, in Step S15, the curves $C_5$, $C_{10}$, . . . and CJ are divided into a number of stitch lengths slen. This curve dividing method will be described with reference to FIG. 10 under the following conditions:

| | |
|---|---|
| Equation of the curve C5 | Y = f(x) |
| Given stitch length | slen |
| Increasing x by unit length (1) | $x_i$ |
| Increment of Y with X increment | dy |
| Points on C5 with increase of xi | p1, p2, p3, . . . |
| Minute length on C5 | dl |
| Sum of the minute lengths on C5 | sdl |

First, a point is marked on the X-axis at the distance $x_i$ from the point A. In this case, the increment of Y is dy which is calculated from the following equation. The value $x_i$ and the value dy thus calculated are employed as the coordinates of the point p1.

$$dy=f(x_i)$$

The minute length between the points A and p1 on the curve $C_5$ is calculated from the following equation, in which "sqrt " is intended to mean taking the square root of the value in the parentheses {}.

$$dl=sqrt\{(xi)^2+(dy)^2\}$$

The above-described operations are carried out for the points p1, p2, p3, . . . to determine the coordinates of them, and the sum sdl is obtained by adding the values dl of them. The point pn which is immediately before the point where the sum sdl exceeds the stitch length slen is determined as the first stitch point from the point A. The point pn is the point $A_1$ in FIG. 4(*b*) .

Upon determination of the first stitch point, the sum sdl is cleared to zero, and new minute lengths dl are added up to determine the next stitch point.

The above-described operations are carried out on the curve $C_5$ to determined stitch points corresponding to the points $A_1$, $A_3$, $A_4$ and $A_5$ in FIG. 4(*b*). In the same way, the points $A_{10}$, $A_{11}$, $A_{12}$, $A_{13}$, . . . $A_{43}$, $A_{44}$ and J on the curves $C_{10}$, $C_{15}$, $C_{20}$, . . . $C_{40}$ and CJ can be obtained.

In Step S16, it is determined whether or not the operations for all the points up to the point J have been accomplished. When it is determined that the operations for all the points have been done, Steps S14 and S15 are effected to perform the operations for the next curve $C_{10}$. Upon completion of the operations for the last curve CJ, the routine is ended leaving Step S16. Thus, the curve inputting operation has been accomplished.

In the above-described case, the inputted point $A_5$ of the curve $C_5$ coincides with the stitch point $A_5$. However, as is seen from the contents of the above description, in general the two points do not coincide with each other. In the case where the inputted point $A_5$ does not come out as a stitch point, the sum slen of minutes lengths is smaller than the specified stitch length. However, this shortage is complemented by summing the minute lengths on the next curve $C_{10}$, so that the last stitch point on the curve $C_5$ is connected expertly to the first stitch point on the next curve $C_{10}$.

As was described above, in the sewing data forming device of the invention, the menu section of the table digitizer has the menu key "Curve Input". Therefore, sewing data to give a fine seam can be formed merely by inputting the coordinate data of a plurality of points on a free curve including its start and end points with the menu key "Curve Input " selected at the start of a sewing data forming operation or during it. Accordingly, the time and labor required for the data inputting operation is reduced to one-fifth to one-tenth of that with the conventional sewing data forming device. In addition, the sewing data formed with the device of the invention is much higher in quality (accuracy and smoothness) than with the conventional device resulting in making the curve connecting the points most natural and smooth.

With the sewing data forming device according to the invention, coordinate data and curve inclination data are provided for two points, to determine a cubic curve connecting the two points. Hence, an amount of calculation to obtain the sewing data is relatively small.

Further, according to the invention, the inclination data of the middle of three points which are inputted successively is automatically calculated from their coordinate values inputted. Hence, it is unnecessary to provide means for applying the inclination data to it.

Furthermore, according to the invention, the inclination data of the first and third points, are automatically calculated from their coordinate values inputted. Hence, similarly as in the case of the device of claim 3, it is unnecessary to provide means for applying the inclination data to them.

In addition, with the sewing data forming device according to the present invention, in the case where a given pattern is of a closed loop (as in the case of a circle or ellipse) the inclination data of the first point is made equal to that of the last point inputted (which is coincident with the first point or close to the latter). Thus, the smooth sewing pattern can be obtained.

What is claimed is:

1. A sewing data forming device for a sewing machine comprising: data input means for inputting coordinate data of a plurality of points along a sewing pattern, said data input means designating an input condition among point input, linear input and curve input;

data storage means for storing data inputted by said data input means successively; and data processing means for applying inclination data to each of said coordinate data so as to form the sewing data between the points adjacent to each other according to a stitch length specified for an interval therebetween;

wherein the input coordinate data of an (N−1)th point, N-th point and N+1)th point are subjected to arithmetic operation, to apply inclination data representing an inclination to the input coordinate data of the N-th point;

wherein the inclination data of the N-th point is obtained by an average of the inclination of a straight line bridging the (N−1)th and N-th points and the inclination of a straight line bridging the N-th and (N+1)th points.

2. A sewing data forming device as claimed in claim 1 wherein the sewing data for tire interval between the points adjacent to each other are formed on a curve approximated by a cubic expression.

3. A sewing data forming device as claimed in claim 1 wherein an inclination of a straight line bridging the first and second points is applied as the inclination data of the first point whereas an inclination of a straight line bridging the last point and the last but one point is applied as the inclination data of the last point.

4. A sewing data forming device as claimed in claim 1 wherein the same inclination data is applied to the first and last points in the case where the coordinate data of the last point is coincident with or close to the coordinate data of the first point.

5. A sewing data forming device as claimed in claim 4 wherein the same inclination data is obtained by the average of the inclination of a straight line bridging the first and second points and the inclination of a straight line bridging the last point and the last but one point.

* * * * *